US005862242A

United States Patent [19]

Takewa et al.

[11] Patent Number: 5,862,242

[45] Date of Patent: Jan. 19, 1999

[54] SPEAKER

[75] Inventors: Hiroyuki Takewa, Kaizuka; Akihiro Furuta, Takatsuki; Kazue Satoh, Neyagawa; Mikio Iwasa, Katano; Kuniaki Sakai, Matsusaka, all of Japan

[73] Assignee: Matsushita Electric Industrial Co., Ltd., Osaka, Japan

[21] Appl. No.: 706,955

[22] Filed: Sep. 3, 1996

[30] Foreign Application Priority Data

Aug. 31, 1995 [JP] Japan ..... 7-223283

[51] Int. Cl.[6] ..... H04R 25/00

[52] U.S. Cl. ..... 381/398; 381/396; 381/405; 381/413

[58] Field of Search ..... 381/182, 193, 381/202, 199, 194

[56] References Cited

U.S. PATENT DOCUMENTS 5,148,492 9/1992 Uzawa et al. ..... 381/193
5,664,024 9/1997 Furuta et al. ..... 381/199

FOREIGN PATENT DOCUMENTS 0101196 5/1986 Japan ..... 381/199

*Primary Examiner*—Sinh Tran
*Attorney, Agent, or Firm*—Beveridge, DeGrandi, Weilacher & Young, LLP

[57] ABSTRACT

A speaker has a diaphragm of which plane shape as seen from a vibrating direction has a major axis and a minor axis, a band-shaped edge connected to the outer circumference of the diaphragm for holding so that the diaphragm may be free to vibrate, and a frame for holding the outer circumference of the edge, wherein a viscoelastic member is affixed to part of the edge and/or diaphragm.

16 Claims, 14 Drawing Sheets

2
11
11
1
4
4'
3
5
8
7
10
6
9

FIG. 14(c)
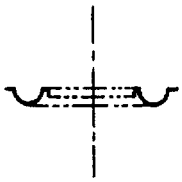
FIG. 14(a)
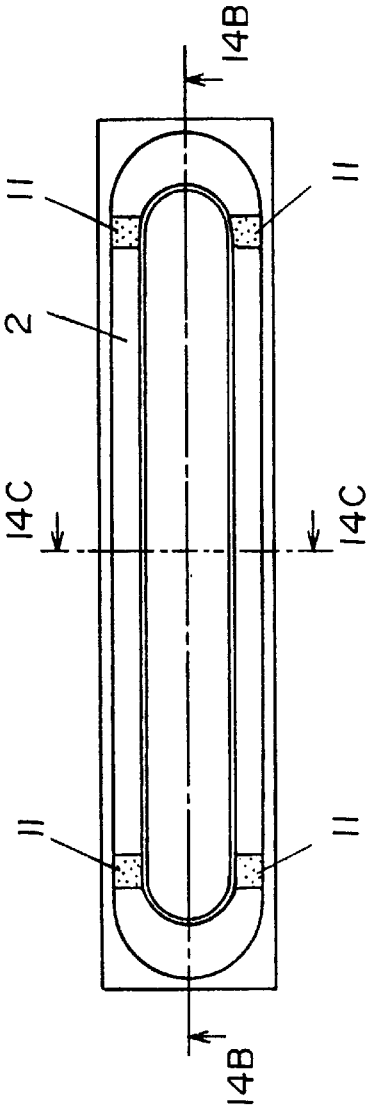
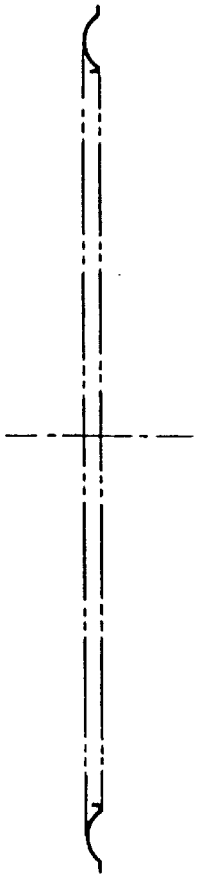
FIG. 14(b)

SPEAKER

BACKGROUND OF THE INVENTION

1. Field of the Invention

The present invention relates to a speaker, and more particularly to a speaker in a slender structure having a diaphragm of narrow width.

2. Related Art of the Invention

The speaker is generally round in shape, but speakers in a slender structure are also widely used, for example, in television applications. The speakers for television are generally installed at both flanks of a cathode-ray tube. In this case, in order to minimize the lateral width of the television, speakers in a slender structure are preferably used.

In the conventional speakers in a slender structure, generally, since the slender diaphragm is driven, torsional resonance in the direction of major axis is likely to be excited if there is any unevenness in the driving force, dimension, weight, etc. As a result, in the mid- or high-range band, peak dip occurs in the reproduced sound pressure frequency characteristic, and it may possibly lead to increase of distortion or deterioration of sound quality.

In the conventional circular speaker, a viscoelastic material was sometimes applied on the entire circumference of the edge adhered to the outer circumference of the diaphragm for suppressing the resonance of the diaphragm. In resonance, the diaphragm vibrates concentrically. Accordingly, the outer circumference of the diaphragm vibrates alike on the whole circumference. As the entire edge circumference is coated with the viscoelastic material, the resistance component can be given to the entire diaphragm, and vibration due to resonance can be braked. However, in the case of torsional resonance which is likely to occur in a speaker in a slender structure, the diaphragm does not vibrate concentrically with the edge. Hence, the vibration amplitude differs from one part to other at the edge coated with the viscoelastic material over the entire circumference of the edge, and the resistance components cannot be given effectively, and there was a problem of increase of weight.

SUMMARY OF THE INVENTION

In the light of the problems of the cone-shaped slim speaker and dome-shaped speaker, it is hence a primary object of the invention to present a speaker unit which is less likely to excite torsional resonance in spite of a slender structure.

To achieve the object, the invention provides a speaker unit comprising a diaphragm of which plane shape as seen from a vibrating direction has a major axis and a minor axis, a band-shaped edge connected to the outer circumference of the diaphragm for holding so that the diaphragm may be free to vibrate, and a frame for holding the outer circumference of the edge, wherein a viscoelastic member is affixed to part of the edge and/or diaphragm, and a speaker unit comprising a diaphragm of which plane shape as seen from a vibrating direction has a major axis and a minor axis, a band-shaped edge connected to the outer circumference of the diaphragm for holding so that the diaphragm may be free to vibrate, and a frame for holding the outer circumference of the edge, wherein an auxiliary mass member is affixed to part of the edge and/or diaphragm.

BRIEF DESCRIPTION OF THE DRAWINGS

FIG. 14 (*a*) is a plan view of an edge of the speaker in each embodiment of the invention, FIG. 14 (*b*) is a sectional view of the edge of the speaker in each embodiment of the invention as seen in an arrow direction of 14A—14A, and FIG. 14 (*c*) is a sectional view of the edge of the speaker in each embodiment of the invention as seen in an arrow direction of 14B—14B.

DESCRIPTION OF THE PREFERRED EMBODIMENTS

The speaker of an embodiment of the invention is described while referring to FIG. 1 to FIG. 7.

Figure 1:
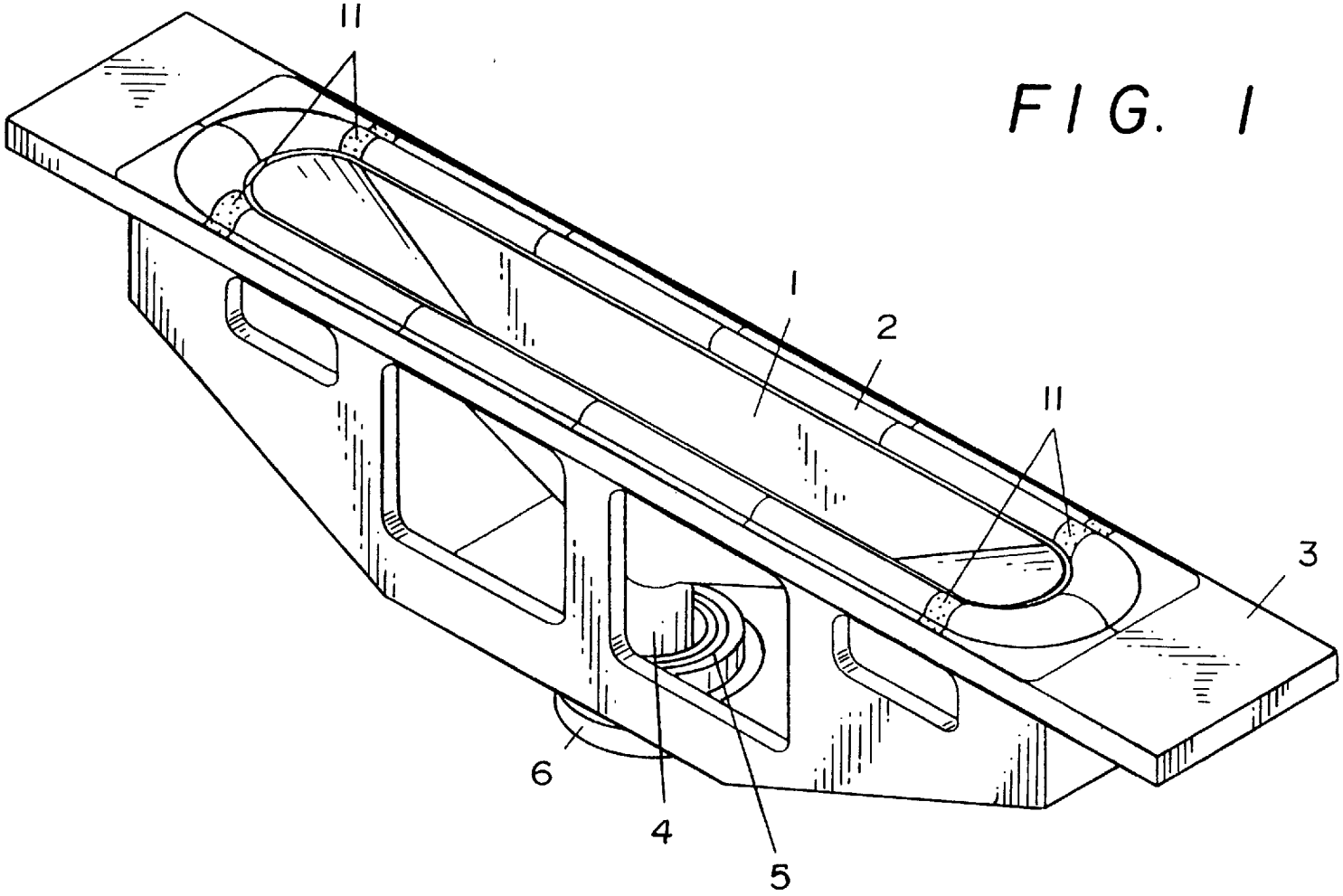
FIG. 1 is a perspective view showing a constitution of a speaker of a first embodiment.
Figure 2:
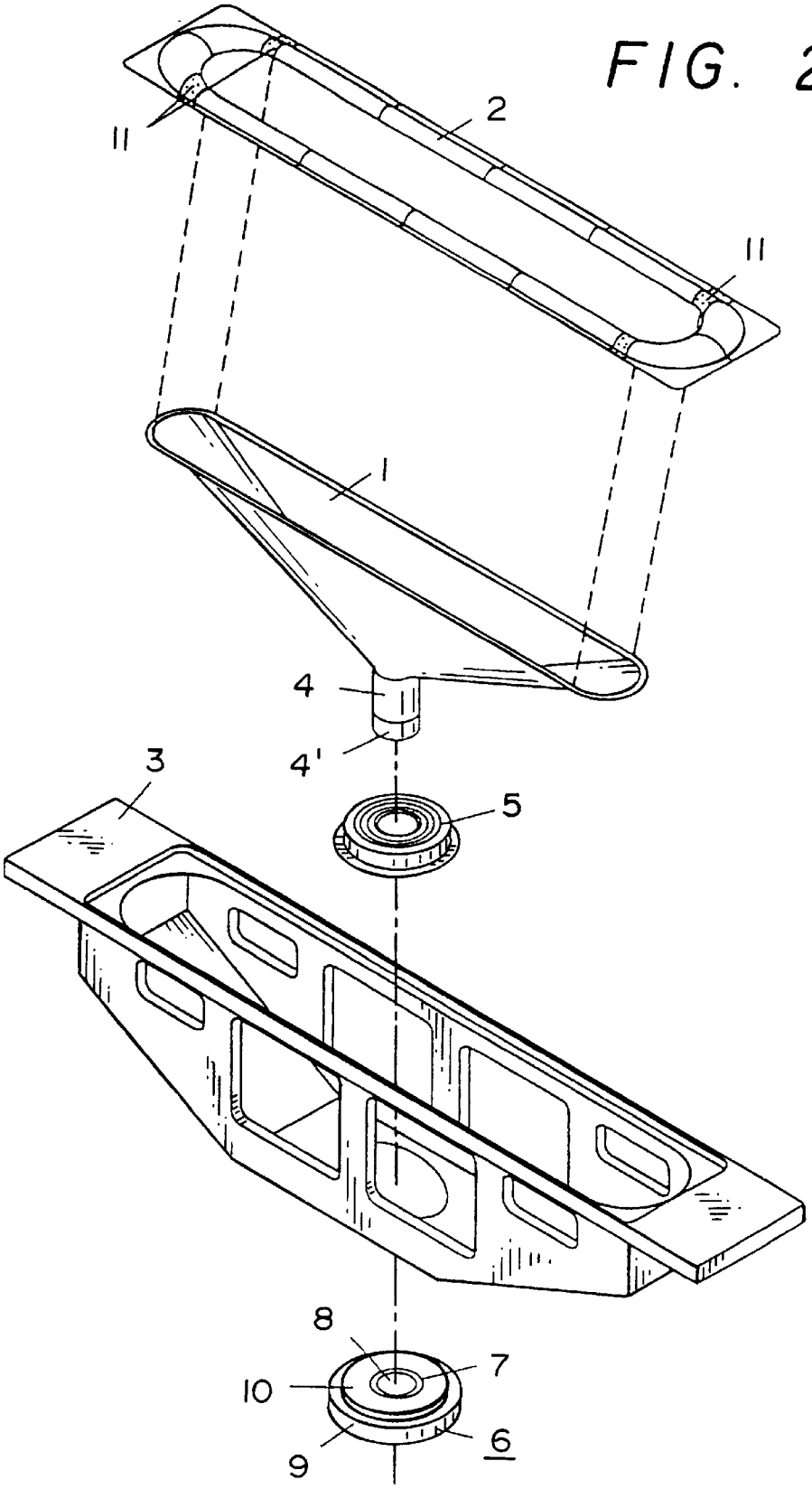
FIG. 2 is an exploded perspective view of the speaker of the first embodiment.

FIG. 1 is a perspective view of a speaker according to a first embodiment of the invention. FIG. 2 is an exploded structural diagram showing its constitution. Reference numeral 1 is a cone-shaped diaphragm curved in a concave form in a sound radiating direction, of which plane shape as seen from a vibrating direction has a major axis and a minor axis. On the outer circumference of the diaphragm 1, an edge 2 is bonded, and is held in a frame 3. At the terminal end in the major axis direction of the edge 2, gel-form viscoelastic members 11 are affixed at four positions near the junction point of straight portion and arc portion. At the lower end of the outer circumference of the diaphragm 1, a voice coil bobbin 4 is affixed. A damper 5 is attached to the voice coil bobbin 4, and affixed to the frame 3. A voice coil 4' is suspended in a magnetic space 8 of a magnetic circuit 6, and generates a driving force by sound signal current and magnetic flux. The frame 3 is composed in a box form, and its side runs along the edge 2. In the bottom of the frame 3, the magnetic circuit 6 is provided. The magnetic circuit 6 is composed of a center pole 8, a magnet 9, and a plate 10, and the magnetic circuit 6 is attached to the frame 3.

Figure 8:
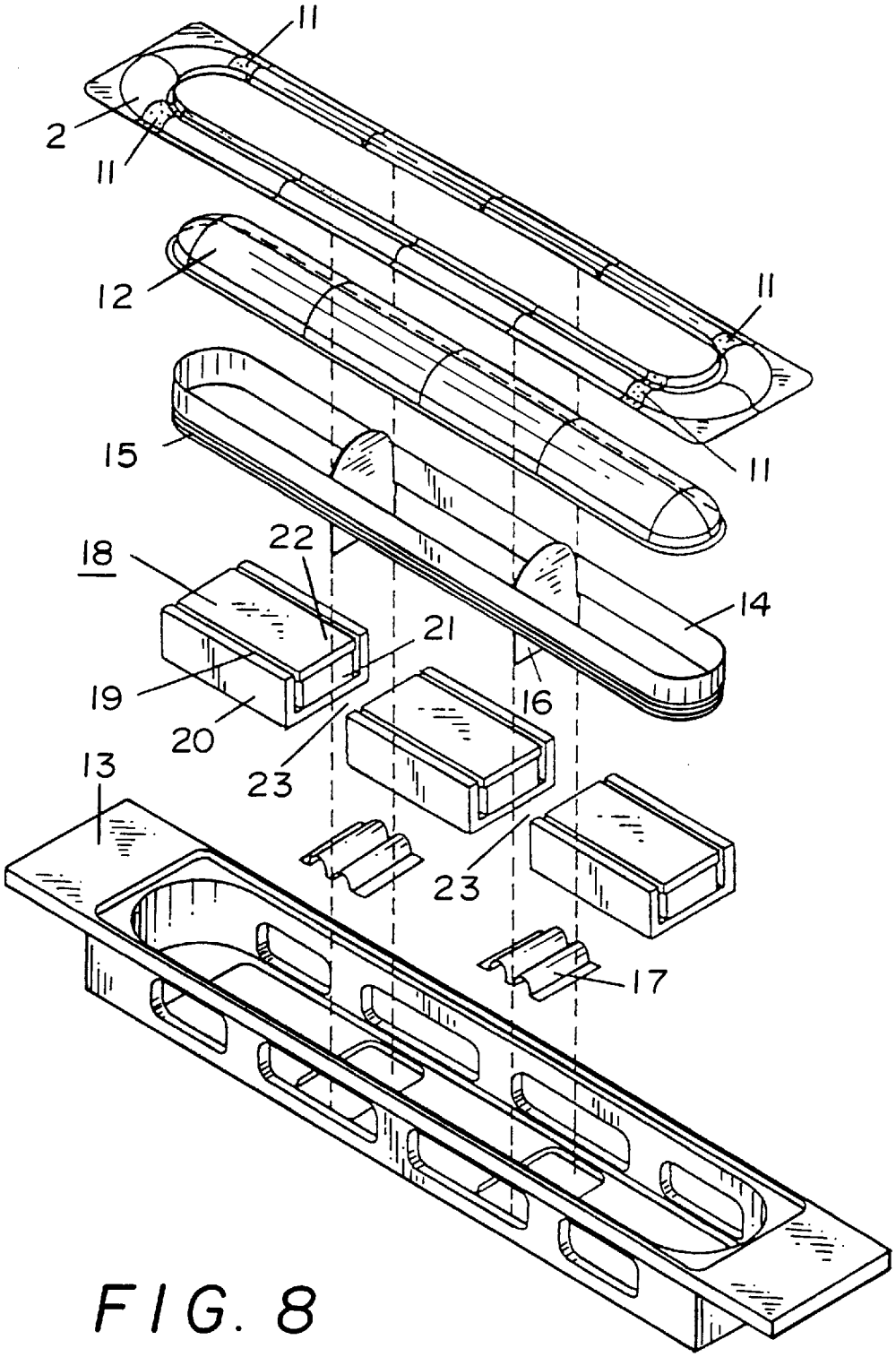
FIG. 8 is an exploded perspective view of a speaker of a second embodiment.

A speaker according to a second embodiment of the invention is illustrated in FIG. 8. FIG. 8 is an exploded structural diagram showing the structure of the speaker of the second embodiment. Same components as in the speaker shown in FIG. 1 are identified with same reference numerals and explanations are omitted.

In FIG. 8, reference numeral 12 denotes an axis-asymmetric diaphragm curved in a convex form in a sound radiating direction, of which plane shape as seen from a vibrating direction has a major axis and a minor axis. An edge 2 is bonded to the outer circumference of this diaphragm, and is held in a frame 13. At the terminal end of the major axis direction of the edge 2, gel-form viscoelastic members 11 are affixed at four positions near the junction point of straight portion and arc portion. At the lower end of the outer circumference of the diaphragm 12, a voice coil bobbin 14 is affixed. A voice coil 15 is wound about the outer circumference of the voice coil bobbin 14. The plane shape of the voice coil bobbin 14 as seen from the vibrating direction of the diaphragm 12 is axis-asymmetrical, having the major axis and minor axis, and the voice coil bobbin 14 has a straight portion mutually parallel about the major axis direction of the diaphragm. Inside of the voice coil bobbin 14, there is a thin plate coupling member 16 for bridging confronting surfaces parallel to the vibration direction of the diaphragm 12 and at right angle to the confronting surfaces. The lower end of the thin plate coupling member 16 is extended further downward from the lower end of the voice coil bobbin 14. A damper 17 is attached to its lower end, and is affixed to the frame 13.

The voice coil 15 is suspended in a magnetic space 19 of a magnetic circuit 18, and generates a driving force by sound signal current and magnetic flux. The frame 13 is composed in a box form, and its side runs along the edge 2. In the bottom of the frame 13, the magnetic circuit 18 is provided. The magnetic circuit 18 possesses a pi-shaped yoke 20, a magnet 21, and a plate 22. A plurality of magnetic circuits 18 are arranged on the frame 13, across a space 23 for passing the thin plate coupling member 16, so that the magnetic spaces 19 may be aligned on a straight line.

The operation and action of the speakers of the first embodiment and second embodiment constituted in such manner are described below.

In a speaker unit of a narrow width, an asymmetric torsional resonance is likely to occur because a slender diaphragm is driven. In the embodiments, however, at the terminal end of the edge, since the gel-form viscoelastic members 11 are affixed at four positions near the junction point of straight portion and arc portion, the torsional resonance is braked by these viscoelastic members.

Figure 3:
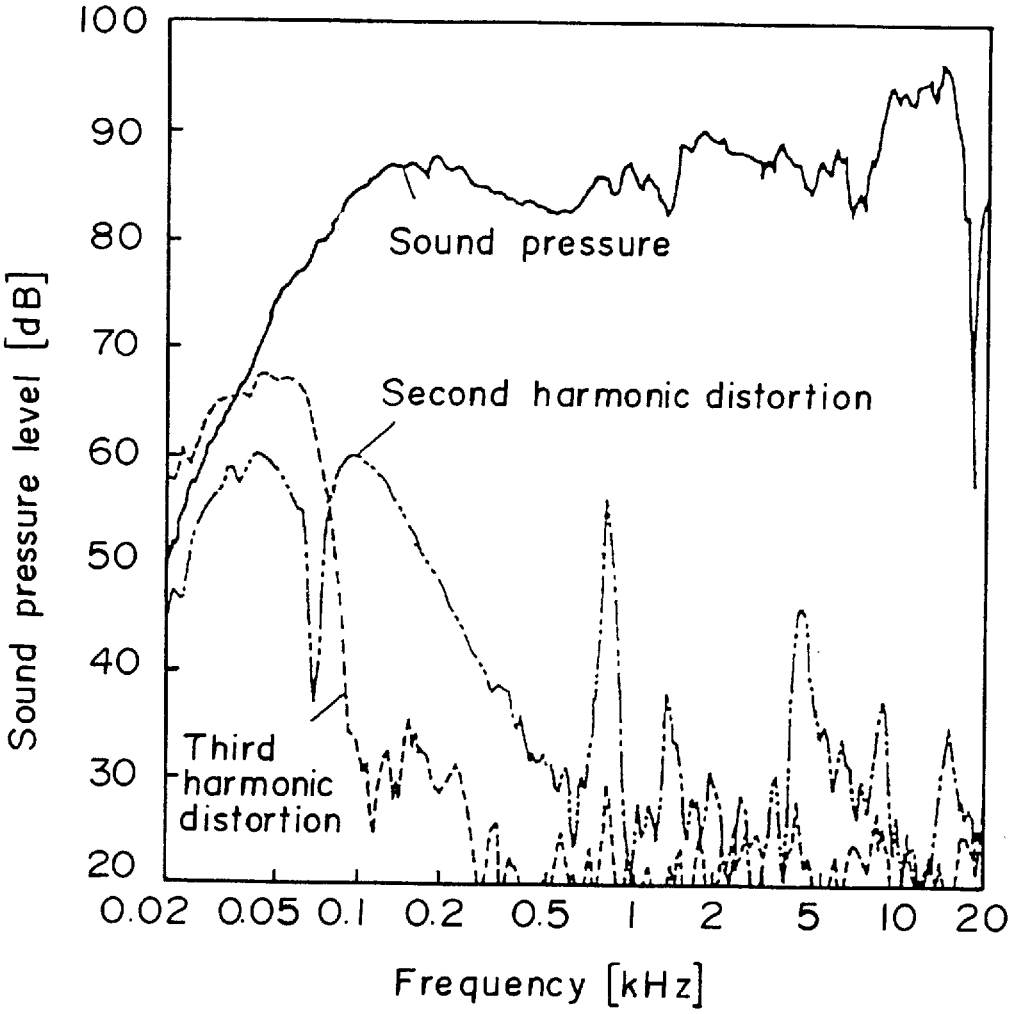
FIG. 3 is a sound pressure frequency characteristic diagram without viscoelastic member.
Figure 4:
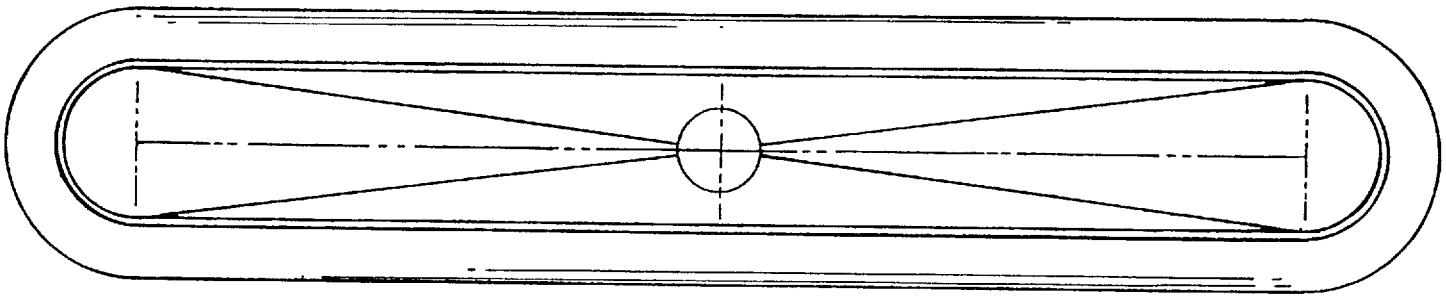
FIG. 4 is a plan view showing a measuring place of vibration mode.

FIG. 3 refers to measurement of sound pressure frequency characteristic in an anechoic room by putting a speaker without gel-form viscoelastic member 11 in a standard box. The axis of abscissas denotes the frequency, and the axis of ordinates shows the sound pressure level. The sound pressure frequency characteristic, and second and third harmonic distortions are shown in FIG. 3. As known from the diagram, a peak of sound pressure takes place at 0.8 kHz, and a second harmonic distortion is generated abruptly. Hence, if a signal is reproduced at 0.8 kHz, a distorted sound is heard and the sound quality is lowered.

Figure 5:
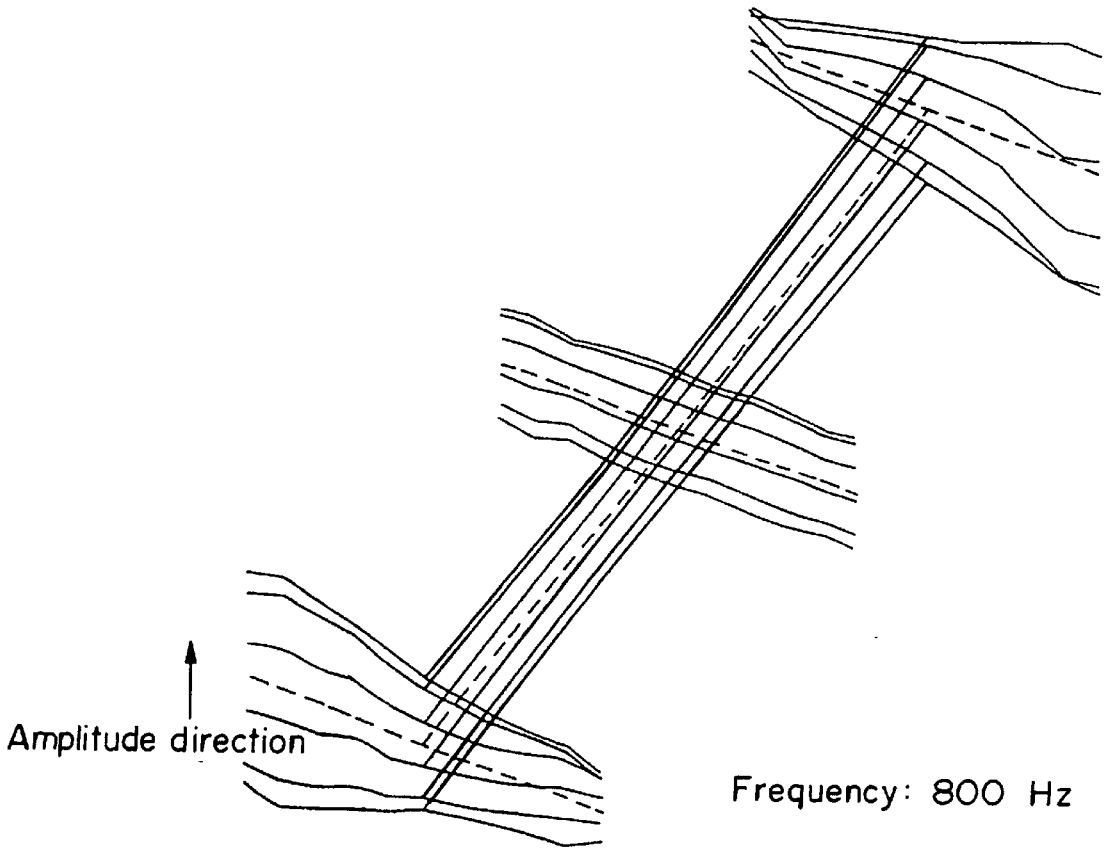
FIG. 5 is a vibration mode diagram without viscoelastic member.

It is FIG. 5 that analyzes the vibration mode at 0.8 kHz where the second harmonic distortion takes place. FIG. 5 shows measurement by laser Doppler vibration analyzer at measuring points on the diaphragm indicated by double dot chain line in a plan view of the diaphragm shown in FIG. 4. By displaying the amplitude of each point by overlapping while deviating the time, a vibration mode of one period is shown. This measuring frequency is 0.8 kHz, and the measured amplitude is magnified in the diagram. As known from the diagram, the central portion of the diaphragm translates and vibrates uniformly, but the end portion in the major axis direction differs in the amplitude at right and left, and at the upper side and lower side of the end portion in the diagram, the deviation is distorted reversely. Thus, in the conventional speaker, at the frequency of 0.8 kHz, the right and left part of the diaphgram's displacement phases of the end portion of the major axis are deviated by 180 degrees, and this deviation is reverse in the upper and lower end portions, thereby causing torsional resonance.

As evident from the vibration mode of torsional resonance (FIG. 5), when the torsional vibration occurs, the amplitude increases at four positions of the terminal end of the edge 2. Since the viscoelastic member acts as resistance when it vibrates, it is effective to suppress the torsional resonance by installing it in a position of a large vibration amplitude as in the embodiments. Moreover, since the viscoelastic members are affixed only in part of the edge, the reproduction efficiency of the speaker is hardly lowered due to weight increase in the vibration system.

Figure 6:
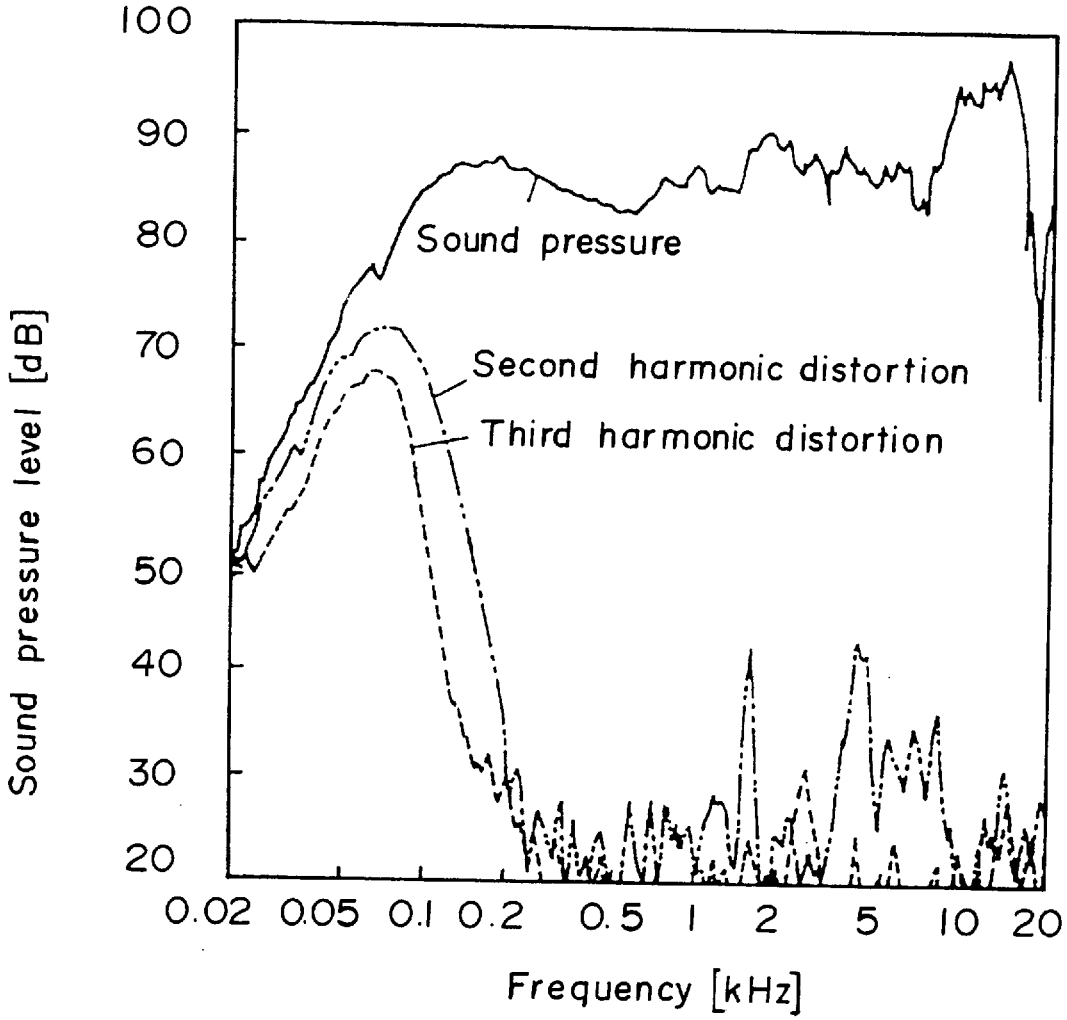
FIG. 6 is a sound pressure frequency characteristic diagram of the first embodiment.
Figure 7:
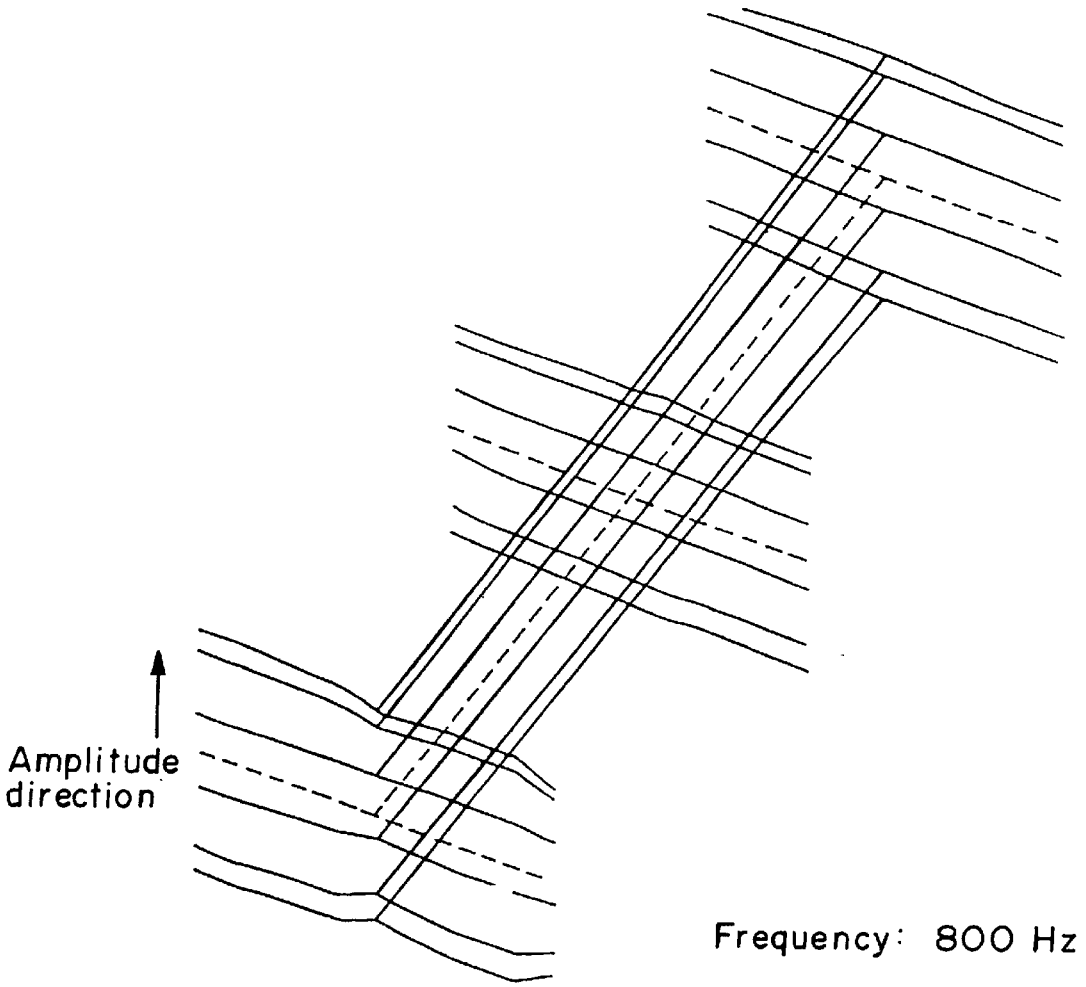
FIG. 7 is a vibration mode diagram of the first embodiment.

FIG. 6 is a sound pressure frequency characteristic diagram of the speaker of the first embodiment. As compared with FIG. 3, it is obvious that the disturbance of sound pressure frequency characteristic and second harmonic distortion at 0.8 kHz are improved. FIG. 7 is a diagram showing a vibration mode at 0.8 kHz. As compared with FIG. 5, both the central portion and end portion in the major axis direction of the diaphragm translate and vibrate, and torsional resonance is evidently suppressed. Same effects are also obtained in the second embodiment.

By thus constituting the speakers of the first embodiment and second embodiment, torsional resonance can be suppressed, and disturbance and distortion of the sound pressure frequency characteristic can be lowered.

Figure 9:
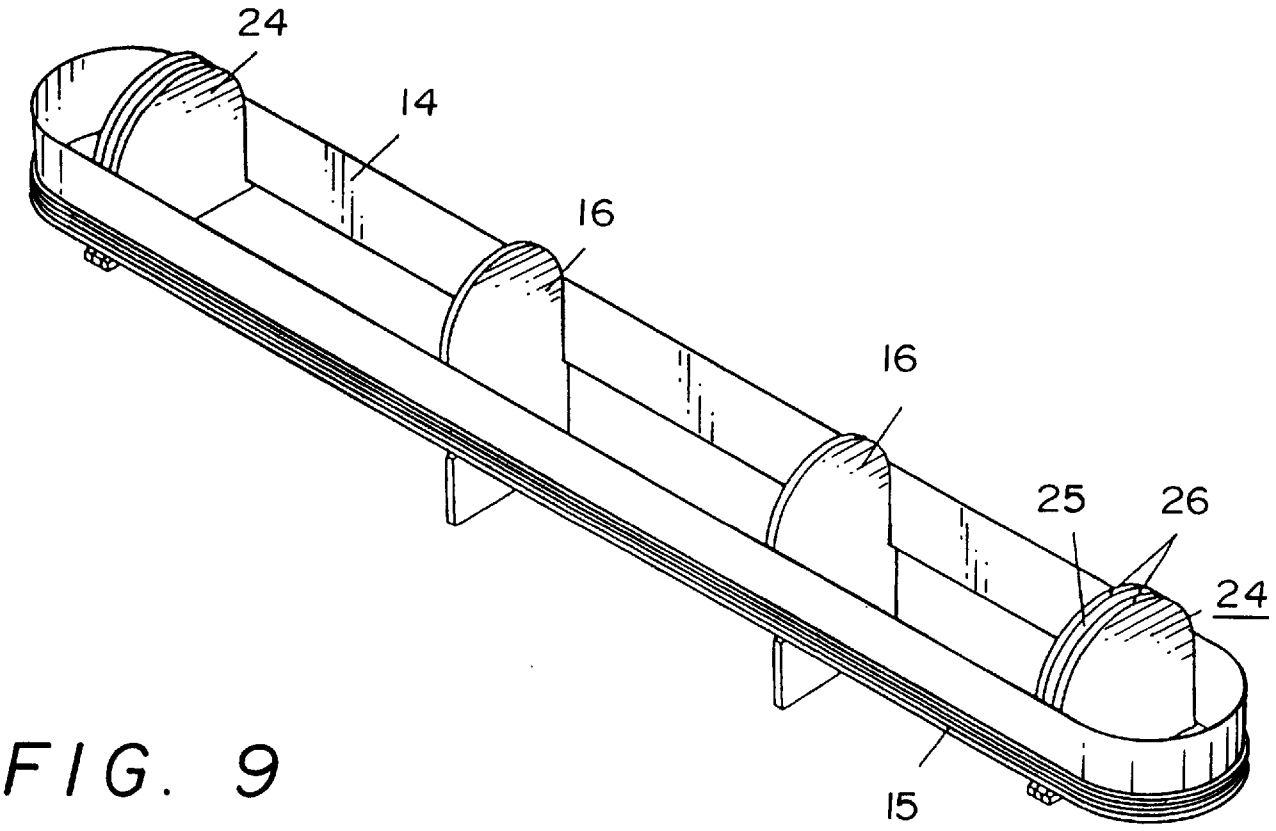
FIG. 9 is a perspective view of a voice coil bobbin of a speaker of a third embodiment.

A third embodiment of the invention is described in FIG. 9. Same components as in the speaker (second embodiment) shown in FIG. 8 are identified with same reference numerals, and the explanations are omitted. The constitution of this embodiment is basically similar to the constitution (FIG. 8) of the second embodiment, and only the manner of installing the viscoelastic members is different.

FIG. 9 is a perspective view of a voice coil bobbin showing the third embodiment of the invention. A voice coil 15 is wound about the outer circumference of a voice coil bobbin 14. The plane shape of the voice coil bobbin 14 as seen from the vibrating direction of the diaphragm 12 is axis-asymmetric, having the major axis and minor axis, and the voice coil bobbin 14 has a straight portion mutually parallel about the major axis direction of the diaphragm. Inside of the voice coil bobbin 14, there is a thin plate coupling member 16 for bridging confronting surfaces parallel to the vibration direction of the diaphragm 12 and at right angle to the confronting surfaces. The terminal end of the straight portion of the voice coil bobbin 14 is in a shape of an arc. At the junction of the straight portion and arc portion, there is a thin plate reinforcing member 24 parallel to the vibrating direction of the diaphragm 12, for bridging at right angle to the confronting surfaces.

In this embodiment, the thin plate reinforcing member 24 is in a sandwich structure enclosing a core 25 in a thin plate form composed of a viscoelastic material such as butyl rubber and asphalt with a thin plate 26 of paper, aluminum, or the like at both sides. The upper end of the thin plate reinforcing member 24 is formed in an arc, and is affixed to the back side of the diaphragm 12, and the lower end is extended to the vicinity of the lower end of the voice coil 15.

The operation and action of the speaker of the third embodiment thus constituted are described below. In a speaker unit of narrow width, since a slender diaphragm is driven, an asymmetric torsional resonance is likely to occur. In this embodiment, however, since the thin plate reinforcing member 24 containing a viscoelastic member is affixed near the terminal end in the major axis direction of the voice coil, the torsional resonance is braked by this viscoelastic member 26. If torsional vibration occurs, the amplitude of the terminal end increases, and torsional resonance is caused, and as clear from the vibration mode diagram in FIG. 5, the voice coil is also twisted, and the terminal end is deformed. In the constitution of the embodiment, however, a compressive stretching force acts on the thin plate reinforcing member 24, and the thin plate reinforcing member 24 expands in the minor axis direction of the diaphragm, and deflects in the major axis direction. At this time, the viscoelastic member 25 in the core is compressed and stretched from the boundary of the neutral point of the sandwich structure. The elastic member makes contradictory actions of compression and stretching from the boundary of the neutral axis, and acts in the direction for suppressing the resonance by the viscosity of the material. The sound pressure frequency characteristic of the constitution of this embodiment is similar to the characteristic in FIG. 6. Thus, according to the constitution of the speaker of the embodiment, torsional resonance can be suppressed, and disturbance of sound pressure frequency characteristic and distortion can be decreased.

Figure 10:
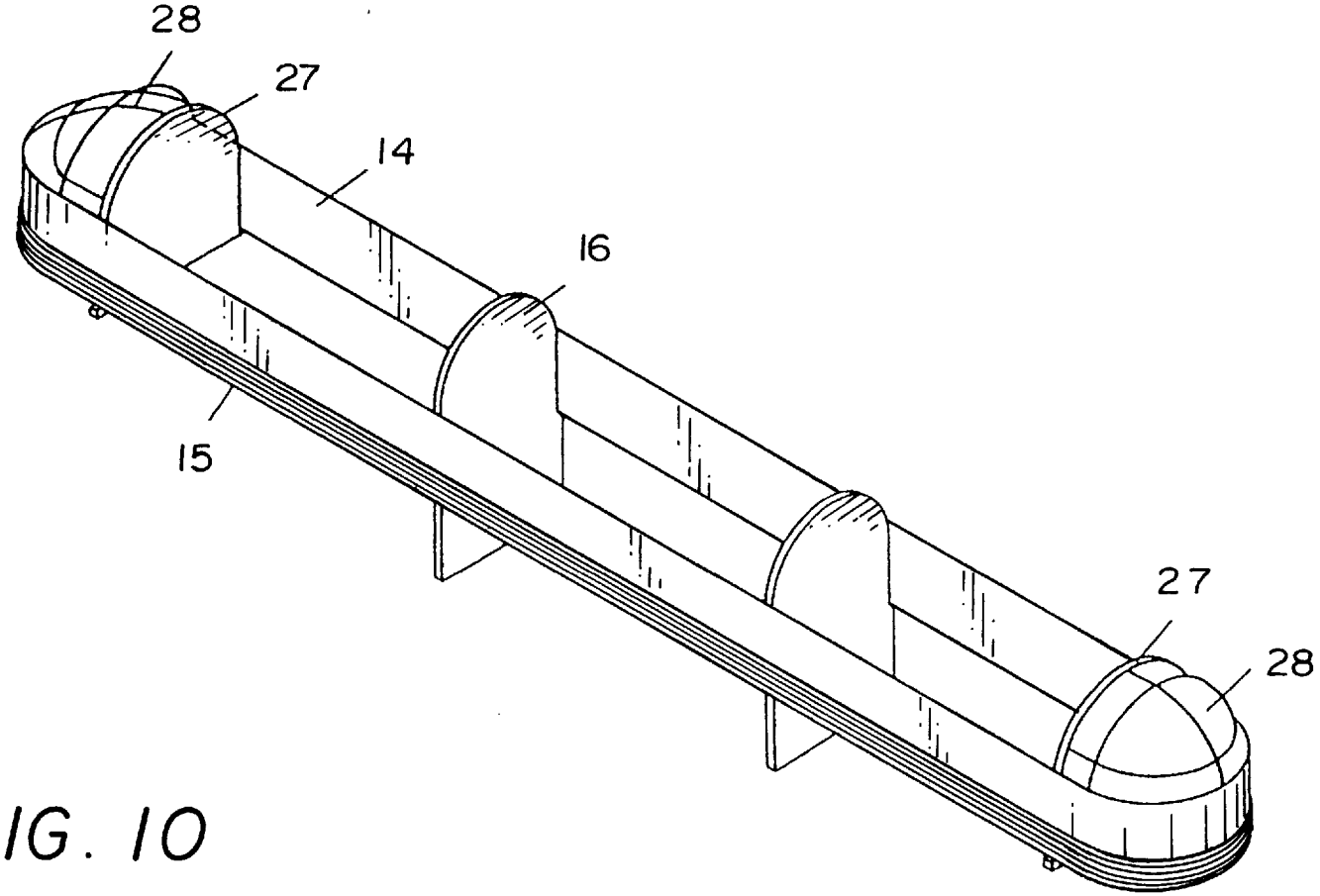
FIG. 10 is a perspective view of a voice coil bobbin of a speaker of a fourth embodiment.

A fourth embodiment of the invention is described while referring to FIG. 10. Same components as in the speaker (second embodiment) shown in FIG. 8 are identified with same reference numerals, and the explanations are omitted. The constitution of this embodiment is basically similar to the constitution (FIG. 8) of the second embodiment, and only the manner of installing the viscoelastic members is different.

FIG. 10 is a perspective view of a voice coil bobbin showing the fourth embodiment of the invention. A voice coil 15 is wound about the outer circumference of a voice coil bobbin 14. The plane shape of the voice coil bobbin 14 as seen from the vibrating direction of the diaphragm 12 is axis-asymmetric, having the major axis and minor axis, and the voice coil bobbin 14 has a straight portion mutually parallel about the major axis direction of the diaphragm 12. Inside of the voice coil bobbin 14, there is a thin plate coupling member 16 for bridging confronting surfaces parallel to the vibration direction of the diaphragm 12 and at right angle to the confronting surfaces. The terminal end of the straight portion of the voice coil bobbin 14 is in a shape of an arc. At the junction of the straight portion and arc portion, there is a thin plate reinforcing member 27 parallel to the vibrating direction of the diaphragm 12, for bridging at right angle to the confronting surfaces.

In this embodiment, in the inner circumference of the diaphragm 12 and in the inner circumference of the voice coil bobbin 14, a viscoelastic lightweight member 28 is affixed. The viscoelastic lightweight member 28 is a foamed material of viscoelastic material, such as foamed butyl rubber and foamed urethane, and is formed in a shape matching with the shape of the inner circumference of the voice coil bobbin 14 and the inner circumference of the diaphragm 12. The edge of the viscoelastic lightweight member 28 is affixed to the outer circumference of the thin plate reinforcing member 27, and the lower end of the edge is extended nearly to the lower end of the voice coil 15.

In the operation and action of the speaker of the fourth embodiment thus constituted are, same as in the third embodiment, when torsional resonance occurs, the viscoelastic lightweight member 28 is deformed, and the resonance energy is absorbed, and generation of resonance is suppressed. The sound pressure frequency characteristic of the constitution of this embodiment is similar to the characteristic in FIG. 6. Thus, according to the constitution of the speaker of the embodiment, torsional resonance can be suppressed, and disturbance of sound pressure frequency characteristic and distortion can be decreased.

Figure 11:
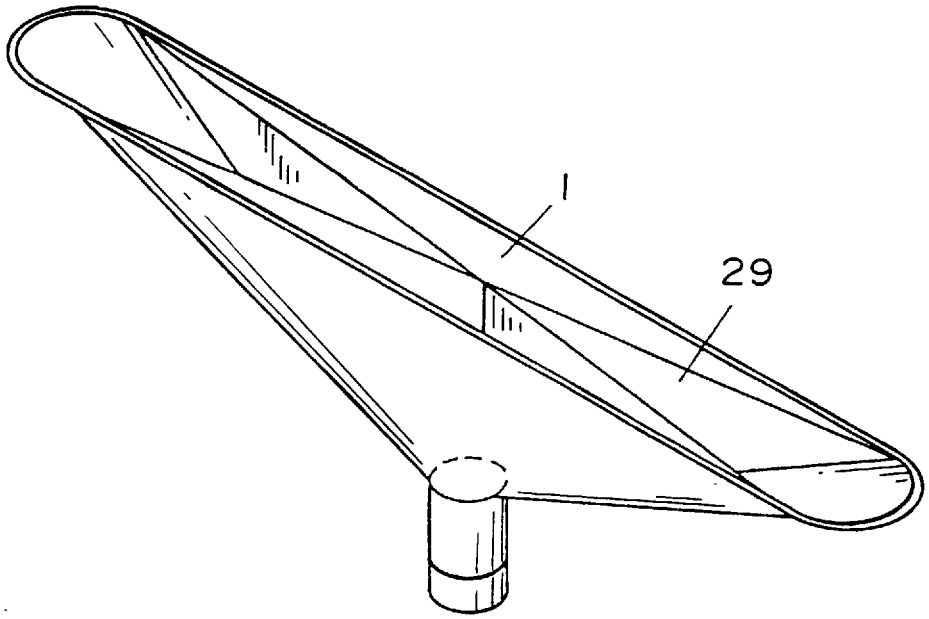
FIG. 11 is a perspective view showing a constitution of a diaphragm of a speaker of a fifth embodiment.
Figure 12:
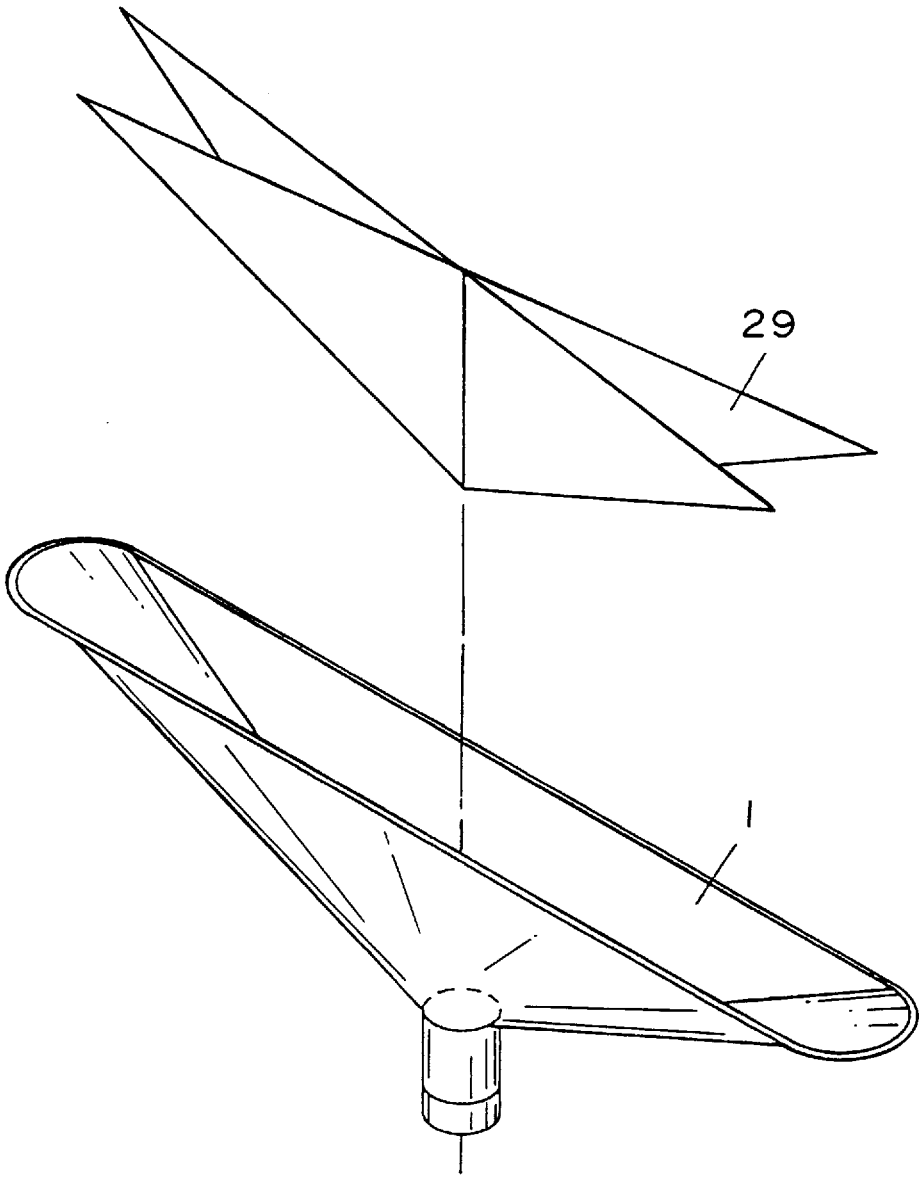
FIG. 12 is an exploded perspective view of the diaphragm of the speaker of the fifth embodiment.

A fifth embodiment of the invention is described while referring to FIG. 11 and FIG. 12. Same components as in the speaker (first embodiment) shown in FIG. 1 are identified with same reference numerals, and the explanations are omitted. The constitution of this embodiment is basically similar to the constitution (FIG. 1) of the first embodiment.

FIG. 11 is a perspective view showing a diaphragm according to the fifth embodiment of the invention, and FIG. 12 is its exploded structural diagram. As clear from the diagram, in the concave portion of a cone-shaped diaphragm 1 curved in a concave form in a sound radiating direction, of which plane shape as seen from a vibrating direction has a major axis and a minor axis, a reinforcing member 29 for reinforcing diagonally the junction point of straight portion and arc portion of the diaphragm is affixed. The reinforcing member 29 is made of material of light weight and high rigidity, such as paper, thin aluminum foil, and titanium foil.

In the speaker of the fifth embodiment thus constituted, the reinforcing material 29 disposed on the diagonal lines of the diaphragm 1 reinforces the diaphragm 1, and acts in a direction for suppressing the amplitude in torsional resonance of the diaphragm 1. Therefore,the speaker of the embodiment suppresses the torsional resonance, and becomes flat in the sound pressure frequency characteristic, and is small in distortion.

Figure 13A:
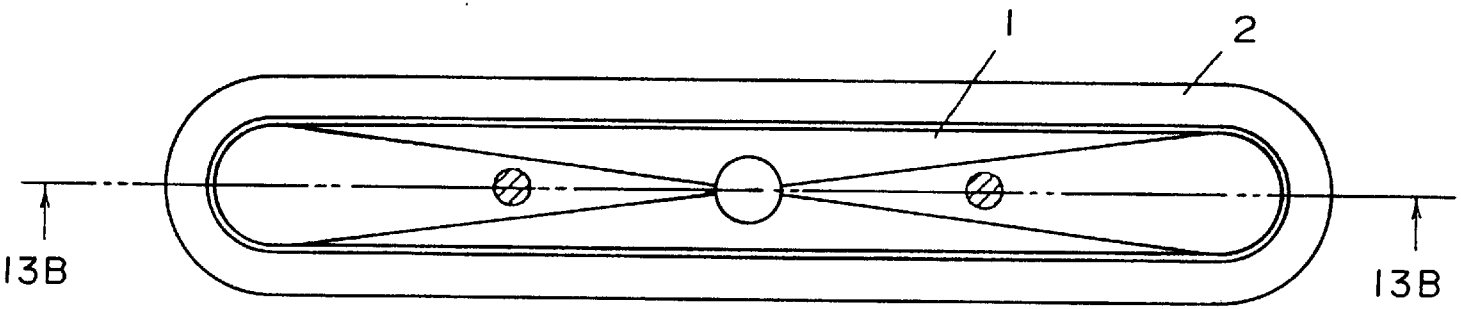
FIG. 13 (*a*) is a plan view of a diaphragm of a speaker of a sixth embodiment, and FIG. 13 (*b*) is a sectional view of the diaphragm of the speaker of the sixth embodiment.
Figure 13B:
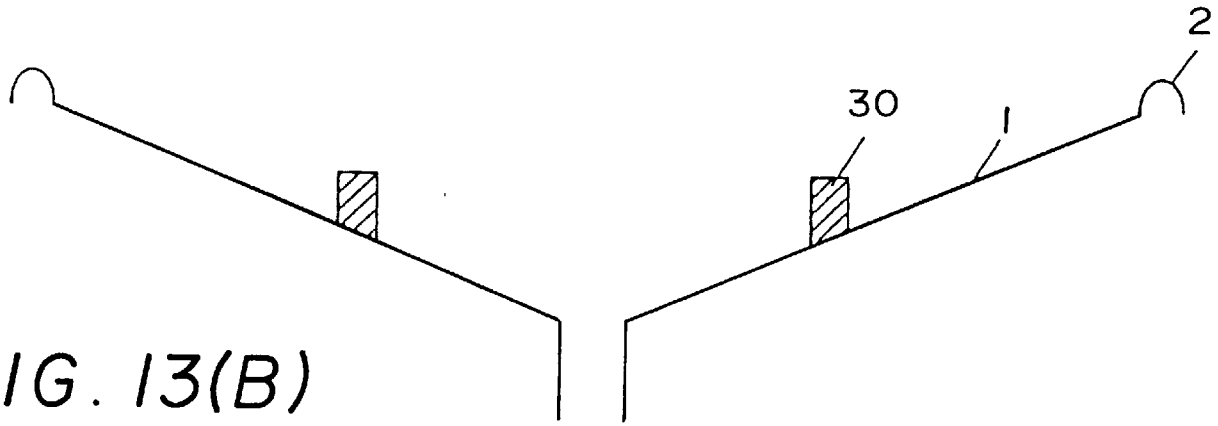

Finally, a speaker in a sixth embodiment of the invention is described while referring to FIG. 13. Same components as in the speaker shown in FIG. 1 are identified with same reference numerals, and the explanations are omitted. The constitution of this embodiment is basically similar to the constitution (FIG. 1) of the first embodiment.

FIG. 13 (*a*) is a plan view showing a diaphragm 1 of the speaker of the embodiment, and FIG. 13 (*b*) is a sectional view seen from arrow direction of 13B—13B in FIG. 13A. On the major axis central axis of the cone-shaped diaphragm 1 curved in a concave form in a sound radiating direction, of which plane shape as seen from a vibrating direction has a major axis and a minor axis, and at symmetrical positions on the axis of symmetry of the minor axis, a lightweight viscoelastic auxiliary mass 30 such as foamed urethane and foamed rubber is adhered.

In the speaker of the embodiment thus constituted, the operation and action are described below. The torsional resonance of the diaphragm is caused by imbalance of shape, weight, and driving force in the minor axis direction from the boundary of the major axis central axis, and in the embodiment, the viscoelastic auxiliary mass adhered on the central axis in the major axis direction works to move the center of gravity onto the central axis, and corrects the imbalance of weight in the minor axis direction. Moreover, being composed of viscoelastic member, the vibration energy is absorbed if resonance occurs, and it functions to suppress the resonance. Accordingly, the speaker of the embodiment reproduces sound without distortion.

Incidentally, the plane shape as seen from the vibrating direction is not limited to two straight line portions mutually parallel about the major axis direction and two arc portions linking them, but may be any slender shape including ellipsis.

Concentrated areas of torsional resonance are not limited to the vicinity of the junction point of the straight portion and arc portion on the outer circumference of the diaphragm and the vicinity of the terminal end in the major axis direction of the diaphragm.

A plan view of the edge 2 of the speaker in each embodiment of the invention is shown in FIG. 14 (*a*), a sectional view seen from arrow direction in diagram along 14B—14B of the edge 2 is given in FIG. 14 (*b*), and a sectional view from arrow direction in diagram along 14C—14C of the edge 2 in FIG. 14 (*c*).

The thin plate coupling member 16 is a practical example of the thin plate coupling member of the invention.

The thin plate reinforcing member 24, thin plate reinforcing member 27, and reinforcing member 29 are practical examples of the plate reinforcing member of the invention.

The viscoelastic lightweight member 28 is a practical example of the viscoelastic member, and not limited to foamed material of viscoelastic material such as foamed butyl rubber and foamed urethane, any material of light weight and viscoelastic property may be used.

The lightweight viscoelastic auxiliary mass 30 is a practical example of an auxiliary mass material using a viscoelastic material of the invention, and it is not limited to foamed urethane and foamed rubber alone.

The reinforcing member 29 may be a sandwich structure enclosing a viscoelastic substance with a thin paper or the like.

The viscoelastic member 11, reinforcing member 29, and lightweight viscoelastic auxiliary mass 30 may be combined.

The thin plate reinforcing member 24 and thin plate reinforcing member 27 may not be necessarily extended nearly to the lower end of the voice coil bobbin 14.

The viscoelastic lightweight member 28 may not be necessarily extended nearly to the lower end of the voice coil bobbin 14.

What is claimed is:

1. A speaker, comprising:

a diaphragm having a manor axis and a minor axis;

a frame; and a band-shaped edge connected to the diaphragm and engaging a portion of the frame, the edge allowing the diaphragm to freely vibrate, wherein at least one viscoelastic member is engaged with a portion of the edge, said viscoelastic member suppresses torsional resonance, the outer portion of the diaphragm possesses two straight portions substantially parallel to each other and two arc portions linking the two straight portions, and the viscoelastic member is engaged at a portion of the edge near a junction point between a straight portion and an arc portion.

2. The speaker of claim 1, wherein the diaphragm has a plate form reinforcing member disposed as a resistance to torsional resonance, on a concave curved portion of the diaphragm so as to diagonally link the terminal ends of the straight portions.

3. The speaker of claim 2, wherein the plate form reinforcing member comprises a structure sandwiching a viscoelastic material with a thin material.

4. The speaker of claim 1, wherein the diaphragm has a plate form reinforcing member composed of a viscoelastic material disposed as a resistance to torsional resonance, inside of a convex curved portion of the diaphragm, so as to be connected to the inner surface of the diaphragm to be orthogonal to the major axis direction, and the plate form reinforcing member is provided so that its outer surface passes near the junction point of the arc portions and straight line portions.

5. The speaker of claim 4, wherein a tubular voice coil bobbin is connected to the outer circumference of the diaphragm in a reverse direction to a sound radiating direction, and the plate form reinforcing member is extended and linked to the inner circumference of the voice coil bobbin.

6. The speaker of claim 5, wherein the plate form reinforcing member comprises a structure sandwiching a viscoelastic material with a thin material.

7. The speaker of claim 1, wherein the diaphragm is curved in a convex form, a tubular voice coil bobbin is connected to the diaphragm in a reverse direction to the sound radiating direction, and an inner viscoelastic member is engaged with a portion corresponding to the arc portion of the inner surface of the voice coil bobbin.

8. The speaker of claim 7, wherein the viscoelastic member is a foamed material of viscoelastic substance.

9. The speaker of claim 7, wherein a plate form reinforcing member composed of a viscoelastic substance is connected as a resistance to torsional resonance to the inner surface of the diaphragm and the inner surface of the voice coil bobbin, orthogonally to the major axis direction, so that the outer surface of the plate form reinforcing member is disposed in the vicinity of a junction point of an arc portion and a straight portion.

10. The speaker of claim 9, wherein the plate form reinforcing member comprises a structure sandwiching a viscoelastic material with a thin material.

11. The speaker of claim 9, wherein a thin plate coupling member orthogonal to the major axis direction is engaged with the inner surface of the diaphragm, and the thin plate coupling member is extended and coupled to the inner surface of the voice coil bobbin.

12. A speaker, comprising:

a diaphragm having a major axis and a minor axis;

a frame; and a band-shaped edge connected to the diaphragm and engaging a portion of the frame, the edge allowing the diaphragm to freely vibrate;

wherein at least one auxiliary mass member is engaged with an interior portion of the diaphragm;

the auxiliary mass member suppresses torsional resonance; and the diaphragm has a plate form reinforcing member disposed, as a resistance to torsional resonance, on a concave curved portion of the diaphragm so as to diagonally link the terminal ends of the straight portions.

13. The speaker of claim 12, wherein the plate form reinforcing member comprises a structure sandwiching a viscoelastic material with a thin material.

14. A speaker, comprising:

a diaphragm having substantially straight portions defining a major axis;

a frame;

a band-shaped edge connected to the diaphragm and engaged with the frame, the edge permitting free vibration of the diaphragm relative to the frame; and a plate form reinforcing member disposed, as a resistance to torsional resonance, on a concave portion of the diaphragm so as to diagonally link the terminal ends of the straight portions.

15. A speaker, comprising:

a diaphragm having a major axis and a minor axis;

a frame; and a band-shaped edge connected to the diaphragm and engaging a portion of the frame, the edge allowing the diaphragm to freely vibrate, wherein at least one viscoelastic member is engaged with a portion of the edge, said viscoelastic member suppresses torsional resonance, and the at least one viscoelastic member comprises exactly four viscoelastic members.

16. The speaker of claim 15, wherein:

the viscoelastic member is solely engaged at a location where torsional resonance is concentrated.

* * * * *